US005853067A

United States Patent [19]

Cutler

[11] Patent Number: 5,853,067

[45] Date of Patent: Dec. 29, 1998

[54] CLIMBING APPARATUS

[76] Inventor: Hurse Adrian Cutler, P.O. Box 24, Bungalow Carins, QLD 4870, Australia

[21] Appl. No.: 638,016

[22] Filed: Apr. 25, 1996

[30] Foreign Application Priority Data

May 15, 1995 [AU] Australia ..... 2956

[51] Int. Cl.[6] ..... A63B 27/00

[52] U.S. Cl. ..... 182/221; 182/134

[58] Field of Search ..... 182/221, 133, 182/134

[56] References Cited

U.S. PATENT DOCUMENTS

| | | | |
|---|---|---|---|
| 1,150,372 | 8/1915 | Jones | 182/221 |
| 1,174,347 | 3/1916 | Ranney | 182/221 |
| 1,956,852 | 5/1934 | Brooks . | |
| 1,983,526 | 12/1934 | Bailey | 182/221 |
| 2,200,450 | 5/1940 | Klein, Jr. . | |
| 2,297,136 | 9/1942 | Detering . | |
| 2,357,159 | 8/1944 | Bennington | 227/27 |
| 2,484,181 | 10/1949 | Munger et al. | 227/27 |
| 2,570,001 | 10/1951 | McCammond | 227/27 |
| 2,604,250 | 7/1952 | Trimble . | |
| 2,835,426 | 5/1958 | Terry | 227/27 |
| 3,414,083 | 12/1968 | Rininger . | |
| 3,724,593 | 4/1973 | O'Keefe . | |
| 4,530,420 | 7/1985 | Hobbs . | |
| 4,574,919 | 3/1986 | Clay . | |
| 5,016,734 | 5/1991 | Greenway | 182/221 |

FOREIGN PATENT DOCUMENTS

| | | | |
|---|---|---|---|
| 177462 | 3/1922 | United Kingdom | 182/221 |

*Primary Examiner*—Alvin Chin-Shue
*Attorney, Agent, or Firm*—Buchanan Ingersoll, P.C.

[57] ABSTRACT

The present invention provides for a climbing apparatus which includes an elongated shank and a stirrup attached to the first end of the shank which is engageable with the footwear of a user. A leg support is attached to the second end of the shank and is engageable with the leg of the user. The climbing apparatus further includes at least one spike attached to either the stirrup or shank to provide support during climbing. The climbing apparatus in accordance with the present invention may preferably include a plurality of tips or replaceable sole attached to a lower surface of the stirrup for gripping the limbs of a tree. The stirrup may include a sole portion and anterior portion rotatably engaged therewith to facilitate the attachment or removal of the climbing apparatus. The sole portion may also include a raised forward surface to define a step for secure engagement with the footwear of the user. The stirrup and the leg support are preferably rotatably attached to the shank and a spring and pin may be positioned intermediate the shank and leg support to permit pivoting or rotation of the leg support and absorption of forces.

28 Claims, 6 Drawing Sheets

CLIMBING APPARATUS

BACKGROUND OF THE INVENTION

1. Field of the Invention

The invention relates to a climbing apparatus, and more particularly to a climbing apparatus that is attached to the leg and foot of the climber to assist with the climbing of trees and wooden poles.

2. Description of the Related Art

Known climbing irons or apparatus consist of a shank having a sleeve at one end adapted to be attached around the shin of a wearer and a stirrup at the opposite end of the shank upon which the wearer's foot rests during use. A single replaceable spike or gaff projects outwardly from the shank adjacent the stirrup end of the shank and is adapted to penetrate into the tree being climbed by the wearer of the climbing iron. A strap extends from a free end of the stirrup and around a part of the shank and is employed to anchor the wearer's foot relative to the stirrup. The shin receiving sleeve is provided with an adjustable strap for securing the sleeve relative to the wearer's shin. In some instances, the position of the sleeve along the length of the shank is adjustable to allow the climbing iron to be adjusted to suit different leg lengths.

Such climbing irons or apparatus require the use of a relatively large spike or gaff and when employed to climb trees often result in unnecessary damage to the tree and a particularly large scar results which does not provide for cambium rejuvenation and often a resultant orifice remains in which water may accumulate and which gives rise to bacteria and fungal infection in the scar remaining in the tree.

The spike or gaff employed in such a climbing apparatus typically has a large triangular transverse cross sectional shape.

The stirrup in such apparatus is typically substantially the same width as the shank and as a consequence does not adequately support the wearer's foot. The strap extending from the free end of the stirrup does not allow the climbing apparatus to be adequately secured to the wearer's foot.

Known climbing apparatus of this general type are not particularly comfortable in use and the way in which such apparatus are secured to the wearer's foot do not accommodate the natural shape and foot movement.

Other devices have been introduced to assist people with the climbing of trees, wooden poles and other wooden structures.

In particular, U.S. Pat. No. 2,297,136 to Detering discloses a climbing spur having a shin support and stirrup which are rotatably engaged with opposite ends of a shank. In addition, a spike is attached to a lower portion of the shank at a position generally adjacent the stirrup. Further, the climbing spur teaches an adjustable stirrup engageable with boots having a variety of widths.

U.S. Pat. No. 4,530,420 to Hobbs discloses a leg protector and socket for climbers which includes a gaff and stirrup attached to a first end of a shank. A shin support which includes a socket member and flexible pad is attached to an opposite end of the shank. The shin support is rotatable relative to the shank and the flexible pad operates as a shock absorber between the shin support and shin of the wearer of the device.

U.S. Pat. No. 2,604,250 to Trimble teaches a lineman's climbing tool which includes a shin support and stirrup attached to a shank. Further, the climbing tool has a pair of spikes attached to the shank adjacent the stirrup. However, any movement of the operator's leg will cause disengaging action inasmuch as one spike will act as a lever against the other during operator movement.

U.S. Pat. No. 3,724,593 to O'Keefe teaches a rope climbing device which has an adjustable stirrup engageable with boots of different widths.

U.S. Pat. No. 3,414,083 to Rininger discloses a climber or hiker assist device having two side members which form a stirrup at one end and are attachable to the shin of a wearer at the second ends thereof.

SUMMARY OF THE INVENTION

The present invention provides for a climbing apparatus which includes an elongated shank and a stirrup attached to the first end of the shank. The stirrup is engageable with the footwear of a user and the stirrup preferably includes a sole portion, medial portion and anterior portion. A leg support is attached to the second end of the shank and is engageable with the leg of the user.

The climbing apparatus according to the present invention further includes at least one spike preferably attached to the stirrup and the at least one spike pierces the object being climbed to provide support during climbing. Preferably, the climbing apparatus includes two spikes inasmuch as the spikes may be smaller in size and less likely to inflict permanent damage to the tree or other object being climbed. Also the twin spikes combined with the pivot system provides a stable platform for the operator that does not disengage due to leg and body movement.

The climbing apparatus in accordance with the present invention preferably includes a plurality of tips on a lower surface of the sole portion for gripping the limbs of a tree. In addition, an anterior portion of the stirrup may be rotatably engaged with the sole portion to facilitate the attachment or removal of the climbing apparatus. The sole portion may also include a raised forward surface to define a step for secure engagement with the footwear of the user.

The stirrup and the leg support are preferably rotatably attached to the shank to provide a natural motion of the foot during use. Furthermore, a spring and pin may be positioned intermediate the shank and leg support to bias the leg support away from the shank to absorb forces and shock and provide a cushion and permit the leg support to pivot with respect to the shank.

A complete understanding of the invention will be obtained from the following description and the accompanying figures.

DETAILED DESCRIPTION OF THE PREFERRED EMBODIMENTS

Figure 1:
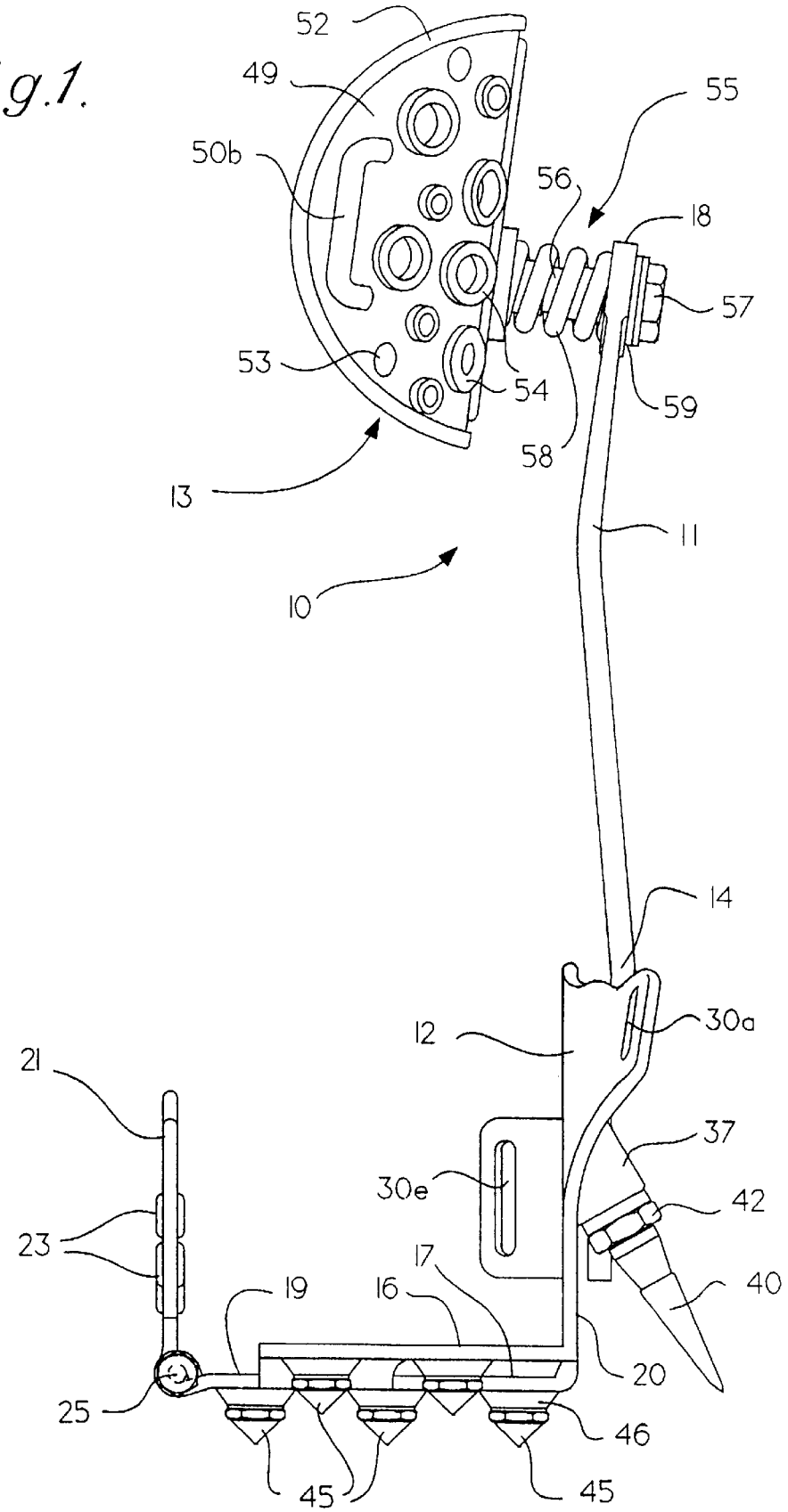
FIG. 1 is a front view of the climbing apparatus in accordance with the present invention which may be worn on the right leg of a user.
Figure 2:
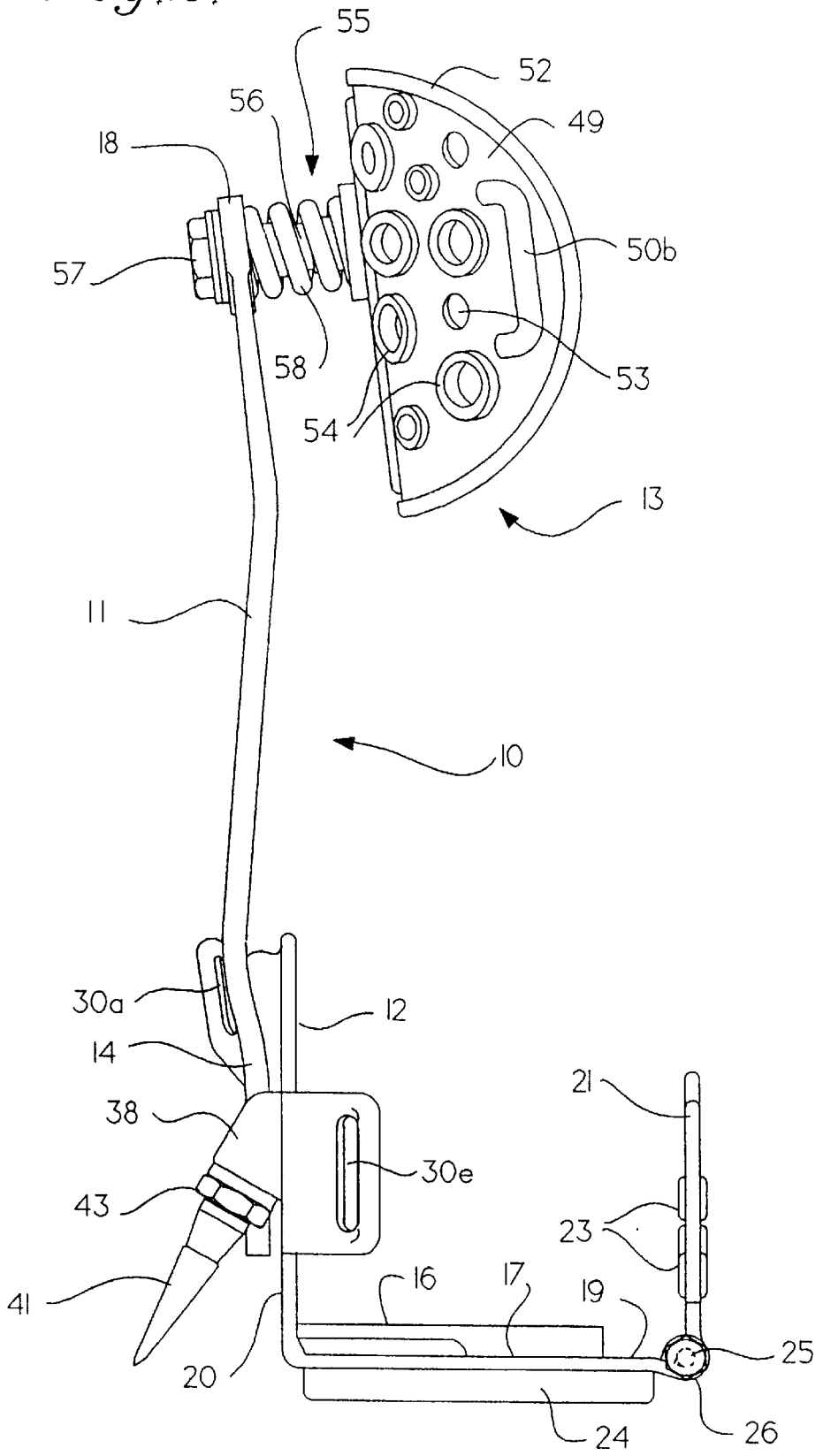
FIG. 2 is a rear view of the climbing apparatus shown in FIG. 1.

As shown in FIG. 1 and FIG. 2, the climbing apparatus 10 in accordance with the present invention includes an elongated shank 11 having a first end 14 and a second end 18. The shank may also be sleeved to allow adjustment for varying leg lengths. A stirrup 12 is preferably attached to the first end 14 of the shank 11 and a leg support 13 is attached to the second end 18 thereof. The first end 14 of the shank 11 may be stepped to ensure that the shank 11 is spaced away from the medial side of the wearer's ankle. The second end 18 of the shank 11 is preferably directed outwardly and away from the leg support 13.

Figure 3:
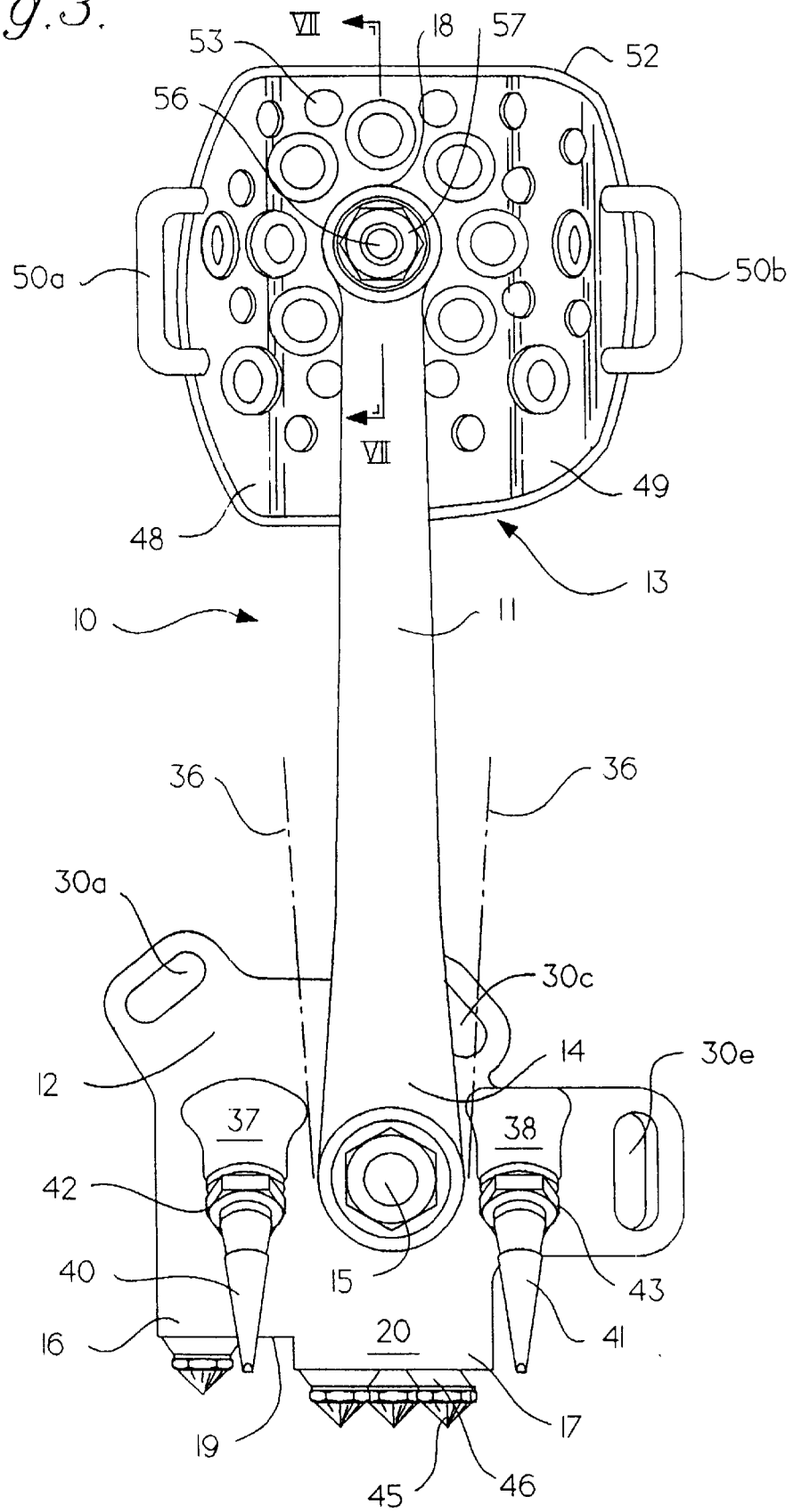
FIG. 3 is a side view of the climbing apparatus shown in FIG. 1.
Figure 5:
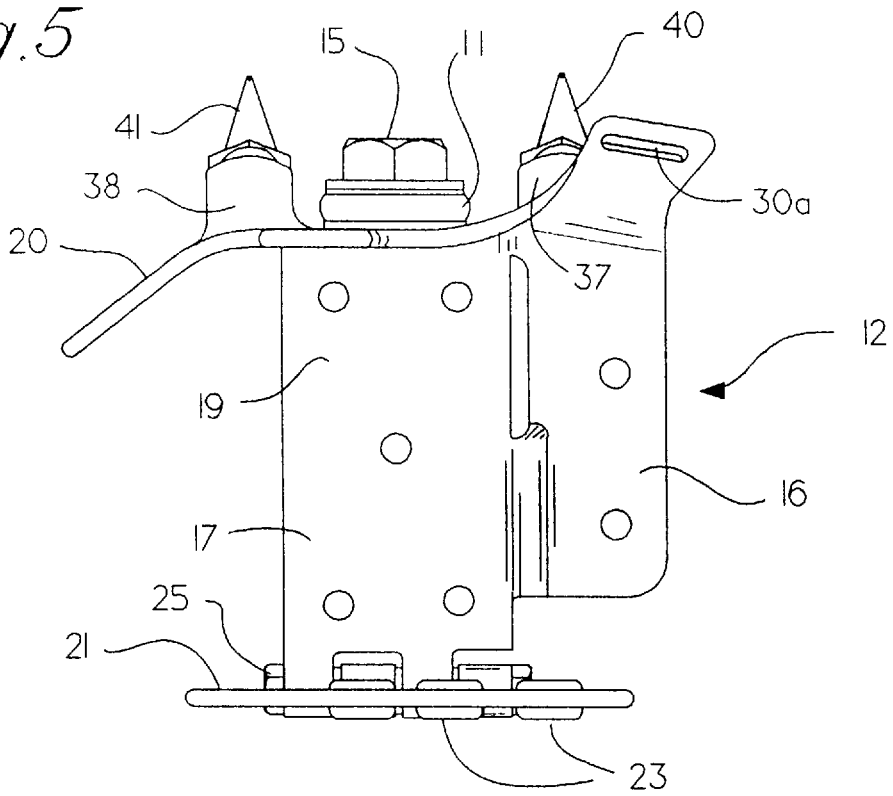
FIG. 5 is a top view of an embodiment of the stirrup of the climbing apparatus.

The stirrup 12 may be pivotally attached to the shank 11 by a fastener 15 as shown in FIG. 3 and FIG. 5. The fastener 15 may include a bolt extending through the shank 11 and stirrup 12 enabling the stirrup 12 to pivot relative to the shank 11 about an axis extending longitudinally through the fastener 15. Preferably, the axis of rotation of the stirrup 12 is perpendicular to the shank 11.

The preferred embodiment of the stirrup 12 includes a sole portion 19, medial portion 20 and anterior portion 21. It is understood that the present invention is not limited to the illustrated preferred embodiment of the stirrup 12 and the stirrup 12 may include in other configurations for holding the footwear of a user.

The medial portion 20 and anterior portion 21 define a space above the sole portion 19 to receive the user's footwear and help prevent the footwear from sliding off of the sole portion 19.

Referring to FIG. 3 and FIG. 5, the sole portion 19 preferably has a step to conform to a shoe or boot worn by the wearer. In particular, the sole portion 19 preferably includes a raised anterior or forward surface 16 and a lower posterior or rear surface 17 to provide the step. The step may engage the heel of the shoe or boot of the wearer to provide a secure fit therewith.

The medial portion 20 may extend upward and away from the sole portion 19 substantially at a right angle as shown in FIG. 1 and FIG. 2. The anterior portion 21 is preferably hinged to the sole portion 19 by a hinge pin 25 and hinge barrel 26 to permit rotation of the anterior portion 21 from a first upright position (shown in FIG. 1) when the climbing apparatus 10 is in use to a second position (not shown) wherein the anterior portion 21 is substantially parallel with the sole portion 19. The user's foot may be easily inserted and removed from the stirrup 12 when the anterior portion 21 is in the second position.

Figure 4:
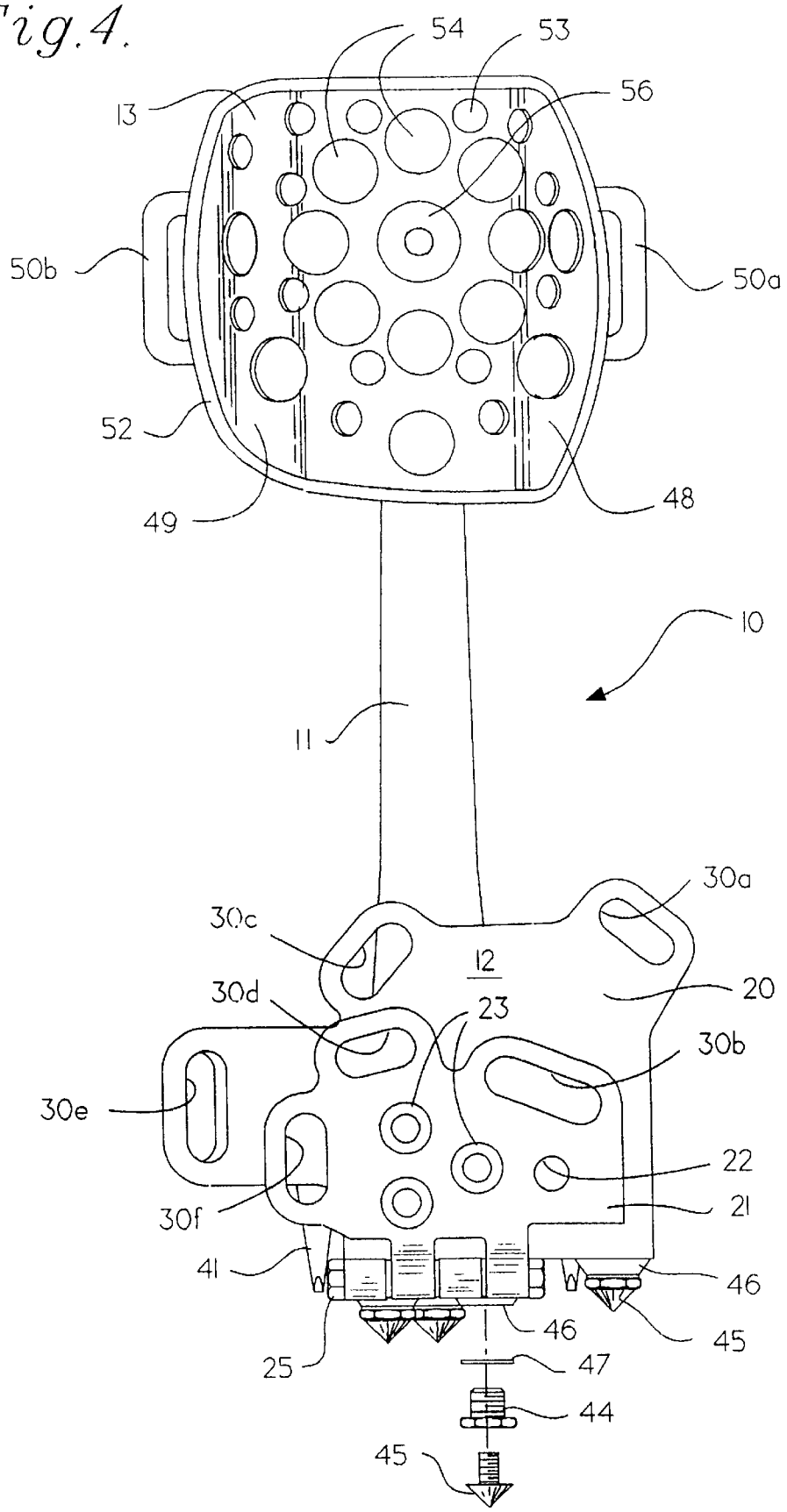
FIG. 4 is an opposite side view of the climbing apparatus shown in FIG. 1.

Referring to FIG. 4, the anterior portion 21 may additionally include a plurality of apertures 22. As shown in FIG. 1, interchangeable rubber grommets 23 having various sizes may be inserted into apertures 22 to provide a form fit between the stirrup 12 and different sized footwear.

Referring again to FIG. 4, the medial portion 20 and the anterior portion 21 of the stirrup 12 each include a plurality of openings 30*a,c,e* and 30*b,d,e* to permit straps (not shown) to be fixed thereto to secure the stirrup 12 to the foot of a user.

In particular, a first strap may be secured to the medial portion 20 of the stirrup 12 at the first opening 30*a* therein and the anterior portion 21 at the second opening 30*b*. The first strap is intended to extend over a forward portion of the wearer's foot. A second strap may be secured to the medial portion 20 at the third opening 30*c* and the anterior portion 21 at a fourth opening 30*d*. The second strap is intended to extend over the arch of the wearer's foot. A third strap may be fixed to the medial portion 20 at a fifth opening 30*e* and the anterior portion 21 at a sixth opening 30*f*. The third strap 30*c* may extend around the heel of the wearer's foot. Each of the straps may include a buckle or similar device for adjusting the tightness of the climbing apparatus 10 upon the wearer's foot.

The climbing apparatus 10 in accordance with the present invention preferably includes one or more spikes 40, 41 or gaffs which preferably extend outwardly and downwardly from the medial portion 20 of the stirrup 12. The spikes 40, 41 may have a circular cross-sectional shape and are configured to pierce the tree, wood pole or wooden structure being climbed. In particular, the spikes 40, 41 may extend outward from the stirrup 12 at an inclined angle enabling penetration of the spikes into the tree, pole or wood structure during the climbing thereof.

The climbing apparatus 10 preferably has two spikes 40, 41 as shown in FIG. 3. Providing two spikes 40, 41 allows smaller spikes to be utilized which inflict less damage upon the wood pole or tree being climbed, whilst further supplying a stable platform for the operator. The climbing apparatus 10 may additionally include two fasteners 42, 43 for removably fastening the spikes 40, 41 to the stirrup 12 or shank 11 to facilitate replacement of the spikes 40, 41. Spike barrels 37, 38 may be interposed between respective fasteners 42, 43 and the stirrup 12.

In addition, providing two spikes 40, 41 in combination with a fastener 15 which permits rotation of the stirrup 12 facilitates disengagement of spikes 40, 41 which are embedded within a tree. In particular, the user may pivot his foot up or down and one of the spikes 40, 41 may act as a lever against the other spike 40, 41 thereby permitting easy and smooth removal of the spikes 40, 41 from the tree.

The spikes 40, 41 may also extend from the shank 11 or other convenient locations on the climbing apparatus 10. However, it is preferred that each spike 40, 41 extend from the medial portion 20 of the stirrup 12 inasmuch as the fastener 15 preferably permits rotation of the shank 11 and movement of the leg of the user. In particular, the stirrup 12 can remain stable and the spikes 40, 41 may remain embedded within the tree during such movement of the user's leg. Spikes attached to a shank of a climbing apparatus may become dislodged from the tree during certain movement of the user's leg resulting in instability.

Figure 6:
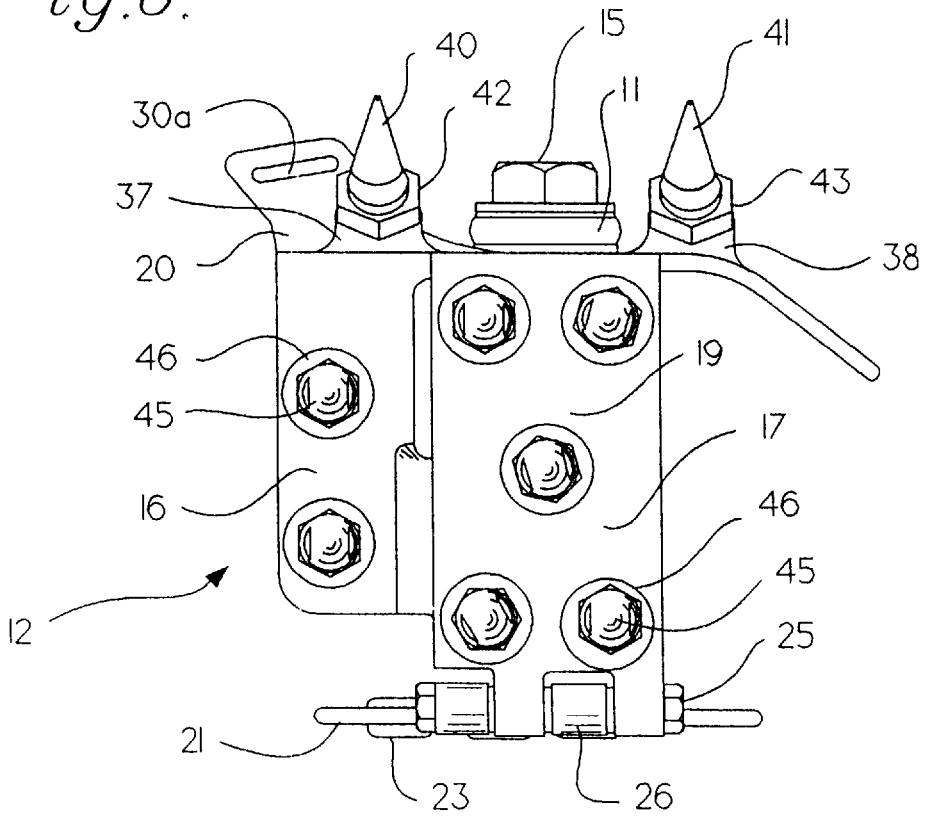
FIG. 6 is a bottom view of the stirrup shown in FIG. 5.

The lower surface of the sole portion 19 of the stirrup 12 may include a grip enhancing finish or a plurality of pointed tips 45 as shown in FIG. 6. The tips 45 are preferably 0.25" in length. The tips 45 provide increased stability when the user of the climbing apparatus 10 walks along the limb of a tree.

A plurality of pads 46 may also be provided on the lower surface of sole portion 19 for removably fastening the tips 45 to the lower surface of the stirrup 12 to facilitate replacement and removal of the tips 45. As shown in FIG. 4, each tip 45 may be screwed into a respective threaded screw 44. The threaded screws 44 and washers 47 provide secure, removable attachment of the tips 45 to the pads 46 and stirrup 12.

Alternatively, a replaceable rubber sole 24 may be attached to the sole portion 19 of the stirrup 12 as shown in FIG. 2. The rubber sole 24 preferably has a grip enhancing finish and provides insulation for use within the electrical industry.

As previously stated, the climbing apparatus 10 also includes a leg support 13 adjacent the second end 18 of the shank 11. As shown in FIG. 4, the leg support 13 may be configured to engage the leg of the user when the climbing apparatus 10 is worn and is therefore preferably substantially arcuate in shape. The climbing apparatus 10 in accordance with the present invention is preferably configured such that the leg support 13 is attached to the shin of the user during use.

The leg support 13 may have a cushion beading 52 to reduce rubbing against the leg of the user. The leg support 13 may additionally include a plurality of apertures 53 to reduce the weight of the climbing apparatus 10. Furthermore, grommets 54 may be provided within the apertures 53 to provide an additional cushioning effect. Alternatively, the entire interior surface of the leg support 13 may be padded.

The leg support 13 may include two anchors 50*a*, 50*b* as shown in FIG. 3 and FIG. 4. A first anchor 50*a* is placed on the exterior of the first side 48 and a second anchor 50*b* is placed on the exterior of an opposite side 49 of the leg support 13. A leg strap (not shown) may be fixed to the anchors 50*a*, 50*b* to secure the climbing apparatus 10 to the leg of the user. The leg strap may additionally include a buckle for adjusting the tightness of the climbing apparatus 10 against the leg of the user.

Alternative means for attaching the climbing apparatus 10 to the leg of a user are also encompassed within the scope of the present invention. In particular, the straps may also be attached to the shank 11 of the climbing apparatus 10.

The leg support 13 is attached to the shank 11 by a fastener 55. The fastener 55 preferably permits the leg support 13 to rotate and pivot relative to the shank 11. Referring to FIG. 1, the leg support 13 is shown in a first position. However, depending upon the height of a user, the leg support 13 may be positioned in a second position as shown in FIG. 2.

Figure 7:
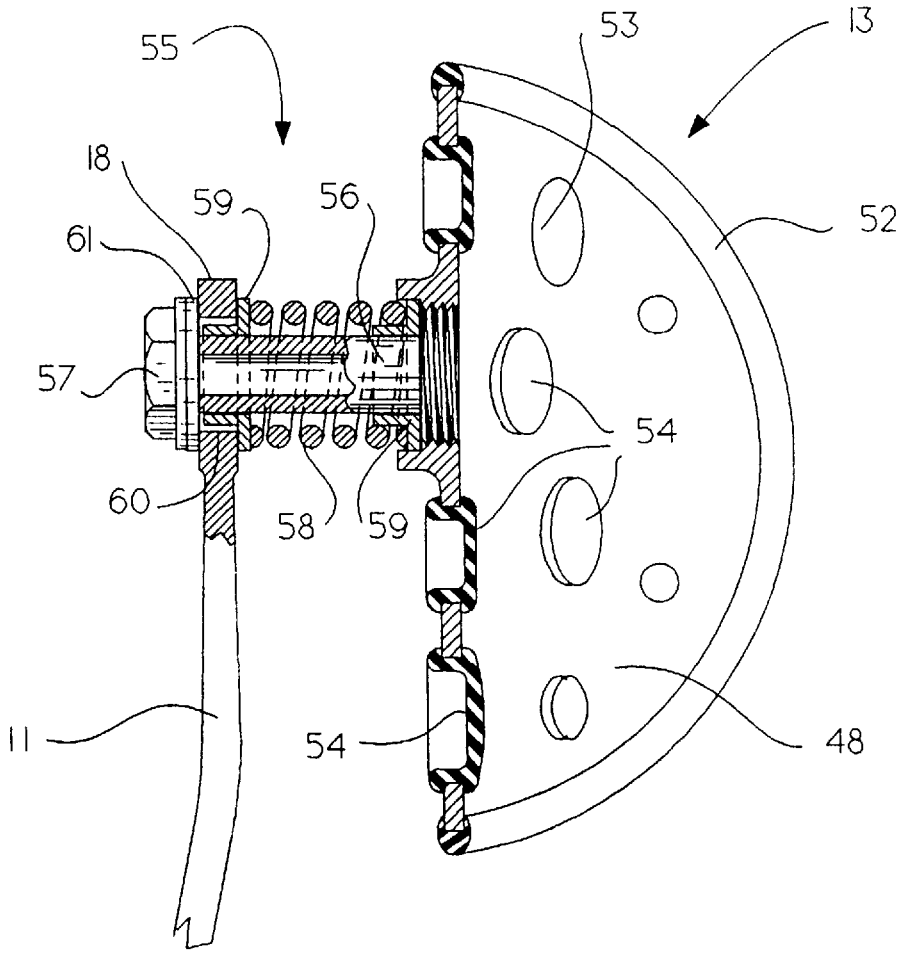
FIG. 7 is a cross-sectional view of the fastener intermediate the leg support and shank of the climbing apparatus taken along line VII—VII of FIG. 3.

A present preferred embodiment of the fastener 55 is shown in detail in FIG. 7. In particular, the fastener 55 includes a floating pin 56 having a nut 57 secured at the first end thereof. The second end of the pin 56 is secured to the leg support 13. An aperture 60 is provided within the shank 11 and the pin 56 may be inserted through the shank 11 to secure the leg support 13 thereto.

A spring 58 may be provided about the pin 56 and intermediate the shank 11 and the leg support 13. Alternatively, a resilient material may be utilized to bias the leg support 13 away from the shank 11. The spring 58 or resilient material normally biases the leg support 13 away from the shank 11 to damp shocks and other forces that may be directed against the leg of wearer. Those forces which act upon the leg support 13 towards the shank 11 will compress the spring 58 and move the pin 56 out away from the shank 11. Thus, the spring 56, cushion beading 52 and grommets 54 reduce the shock on the wearer's foot and leg.

Nylon bushings 59 and nylon washer 61 are provided as shown in FIG. 7 to reduce friction and wear between the shank 11, leg support 13, pin 56 and spring 58. The diameter of the aperture 60 is preferably greater than the diameter of the pin 56 and bushing 59 to permit any point on the perimeter of the leg support 13 to tilt forward and away from the shank 11 to provide 360° tilting or pivoting action of the leg support 13.

The lines 36 in FIG. 3 indicate the various degrees of movement possible with the climbing apparatus 10. The stirrup 12 may pivot with respect to the shank 11 through a range of motion which is limited by the spikes 40, 41. The leg support 13 may rotate 360° about an axis extending through the fastener 55. Providing a climbing apparatus 10 having a rotatable stirrup 12 and leg support 13 allows a more natural movement of the foot while the wearer is climbing.

The shank 11 is preferably formed of Spring Steel XKL9258S for high strength elasticity and durability. The stirrup 12 may be fabricated of a steel having high strength, severe bending and welding characteristics, such as XTRAFORM 500. The shin support 13 may be fabricated of a steel having superior forming ability and strength, such as XTRAFORM 400. The spikes 40, 41 and tips 45 are preferably machined from a high tensile steel, such as AS1444/4140. The anchors 50 and pin 56 arrangement are preferably formed of a Stainless Steel 316 Standard Marine Grade for high resistance to oxidation. The spring 58 may be manufactured from 5.5 Hard Drawn Prehardened R2. The spike barrels 37, 38 and hinge barrel 26 are preferably formed of Bright Steel S1020 Round Bar.

The climbing apparatus 10 may include outer protective coatings. Preferably, shank 11, spikes 40, 41 and tips 45 are chrome plated and fasteners 42, 43, spring 58, the washer intermediate fastener 15 and stirrup 12, the washer within hinge barrel 26, and washers 47 are anodized. The stirrup 12, shin support 13, pads 46 and fastener 15 may be painted with acrylic or 2-pack epoxy.

While preferred embodiments of the invention have been shown and described herein, it will be appreciated by those skilled in the art that various modifications and alternatives to the disclosed embodiments may be developed in light of the overall teachings of the disclosure. Accordingly, the disclosed embodiments are meant to be illustrative only and not limiting to the scope of the invention which is to be given the full breadth of the following claims and all equivalents thereof.

I claim:

1. A climbing apparatus, comprising:

a. an elongated shank having a first end and a second end;

b. a stirrup having a sole portion and a medial portion extending upward and away from the sole portion, the stirrup being rotatably attached to said shank at the first end thereof such that said stirrup is rotatable about an axis generally normal to said shank and rotates in a plane parallel to a plane through a longitudinal axis of said shank, said stirrup sized and configured to be engageable with the footwear of a user;

c. a plurality of tips attached to a lower surface of said sole portion;

d. a leg support attached to said shank at the second end thereof and tiltable relative to said shank; and e. at least one spike attached to said medial portion of said stirrup such that a centerline through the at least one spike will not be parallel to a centerline through any one of said plurality of tips and rotating the stirrup will move the at least one spike relative to the elongated shank.

2. The climbing apparatus of claim 1 wherein said leg support is rotatably attached to said shank.

3. The climbing apparatus of claim 1 wherein said at least one spike is a pair of spikes and each spike of the pair is attached on an opposite side of a longitudinal axis through the shaft.

4. A climbing apparatus, comprising:

a. an elongated shank having a first end and a second end;

b. a stirrup having a sole portion and a medial portion extending upward and away from the sole portion, the stirrup being rotatably attached to said shank at the first end thereof such that said stirrup is rotatable about an axis generally normal to said shank, said stirrup sized and configured to be engageable with the footwear of a user;

c. a plurality of tips attached to a lower surface of said sole portion;

d. a leg support attached to said shank at the second end thereof; and e. at least one spike attached to said medial portion of said stirrup such that a centerline through the at least one spike will not be parallel to a centerline through any one of said plurality of tips and rotating the stirrup will move the at least one spike relative to the elongated shank;

f. said leg support being rotatably attached to said shank; and g. a transversely mounted spring and pin intermediate said shank and said leg support to provide tilting of said leg support and absorption of forces.

5. The climbing apparatus of claim 4 wherein said stirrup further comprises an anterior portion rotatably connected to said sole portion.

6. The climbing apparatus of claim 4 wherein said sole portion further comprises a raised forward surface to define a step therein for secure engagement with the footwear.

7. A climbing apparatus, comprising:

a. an elongated shank having a first end and a second end;

b. a stirrup rotatably attached to said shank at the first end thereof such that said stirrup is rotatable about an axis generally normal to said shank and rotates in a plane parallel to a plane through a longitudinal axis of said shank, said stirrup having a sole portion and an anterior portion being rotatably connected to said sole portion;

said stirrup being sized and configured to be engageable with the footwear of a user;

c. a leg support attached to said shank at the second end thereof and tiltable relative to said shank; and d. at least one spike attached to said stirrup such that said at least one spike extends outwardly and downwardly at an angle relative to said shank and rotating the stirrup will move the at least one spike relative to the elongated shank.

8. The climbing apparatus of claim 7 wherein said leg support is rotatably attached to said shank.

9. The climbing apparatus of claim 7 further comprising a rubber sole attached to a lower surface of said sole portion.

10. A climbing apparatus, comprising:

a. an elongated shank having a first end and a second end;

b. a stirrup rotatably attached to said shank at the first end thereof such that said stirrup is rotatable about an axis generally normal to said shank, said stirrup having a sole portion and an anterior portion being rotatably connected to said sole portion;

said stirrup being sized and configured to be engageable with the footwear of a user;

c. a leg support attached to said shank at the second end thereof;

d. a plurality of tips attached to a lower surface of said sole portion;

e. at least one spike attached to said stirrup such that a centerline through the at least one spike will not be parallel to a centerline through any one of said plurality of tips and rotating the stirrup will move the at least one spike relative to the elongated shank;

f. said leg support being rotatably attached to said shank; and g. a transversely mounted spring and a pin intermediate said shank and said leg support to provide tilting of said leg support and absorption of forces.

11. The climbing apparatus of claim 10 wherein said sole portion has a raised forward surface to define a step therein for secure engagement with the footwear.

12. The climbing apparatus of claim 10 wherein said at least one spike is a pair of spikes and each spike of the pair is attached on an opposite side of a longitudinal axis through the shaft.

13. A climbing apparatus, comprising:

a. an elongated shank having a first end and a second end;

b. a stirrup rotatably attached to said shank at the first end thereof such that said stirrup rotatable about an axis generally normal to said shank and rotates in a plane parallel to a plane through a longitudinal axis of said shank and said stirrup having a lower surface;

said stirrup being sized and configured to be engageable with the footwear of a user;

c. a leg support attached to said shank at the second end thereof and tiltably relative to said shank; and d. at least one spike attached to said stirrup such that said at least one spike extends outwardly and downwardly at angle relative to said shank and rotating the stirrup will move the at least one spike relative to the elongated shank.

14. The climbing apparatus of claim 13 wherein said leg support is rotatably attached to said shank.

15. The climbing apparatus of claim 13 further comprising a transversely mounted spring and a pin intermediate said shank and said leg support to provide tilting of said leg support and absorption of forces.

16. The climbing apparatus of claim 13 wherein said stirrup is comprised of a sole portion having a raised forward surface to define a step therein for secure engagement with the footwear.

17. The climbing apparatus of claim 13 wherein said stirrup is comprised of a sole portion and an anterior portion rotatably connected to said sole portion.

18. The climbing apparatus of claim 13 further comprising a rubber sole attached to said lower surface of said stirrup.

19. The climbing apparatus of claim 13 further comprising a plurality of tips attached to said lower surface of said stirrup.

20. A climbing apparatus, comprising:

a. an elongated shank having a first end and a second;

b. a stirrup rotatably attached to said shank at the first end thereof such that said stirrup is rotatable about an axis generally normal to said shank and said stirrup having a lower surface;

said stirrup being sized and configured to be engageable with the footwear of a user;

c. a leg support attached to said shank at the second end thereof;

d. a plurality of tips attached to said lower surface of said sole portion;

e. at least one spike attached to said stirrup such that a centerline through the at least one spike will not be parallel to a centerline through any one of said plurality of tips and rotating the stirrup will move the at least one spike relative to the elongated shank; and f. a transversely mounted spring and a pin intermediate said shank and said leg support to provide tilting of said leg support and absorption of forces.

21. The climbing apparatus of claim 20 wherein said stirrup is comprised of a sole portion and an anterior portion rotatably connected to said sole portion.

22. The climbing apparatus of claim 21 wherein said sole portion has a raised forward surface to define a step therein for secure engagement with the footwear.

23. The climbing apparatus of claim 20 wherein said at least one spike is a pair of spike and each spike of the pair is attached on an opposite side of a longitudinal axis through the shaft.

24. A climbing apparatus, comprising:

a. an elongated shank;

b. a leg support attached to the shank at one location and tiltable relative to said shank;

c. a stirrup rotatably attached to said shank at a second location spaced from the one location such that said stirrup rotatable about an axis generally normal to said shank and rotates in a plane parallel to a plane through a longitudinal axis of said shank;

d. a plurality of straps extending from one side of the stirrup to another side of the stirrup for allowing a wearer's foot to be secured to the stirrup; and e. at least two spikes attached to the stirrup such that each of said at least two spikes extends outwardly and downwardly at an angle relative to said shank and rotating the stirrup will move the at least two spikes relative to the elongated shank and said at least two spikes arranged at spaced locations along a direction defined by the wearer's foot and extending outwardly and downwardly at an inclined angle relative to the shank so that the spikes are able to penetrate into a tree being climbed by the wearer of the climbing apparatus.

25. The climbing apparatus of claim 24 wherein said stirrup comprises a sole portion having a raised forward surface to define a step therein for secure engagement with the wearer's foot.

26. A climbing apparatus, comprising:

a. an elongated shank;

b. a leg support attached to the shank at one location;

c. a stirrup rotatably to said shank at a second location spaced from the one location such that said is stirrup rotatable about an axis generally normal to said shank;

d. a plurality of straps extending from one side of the stirrup to another side of the stirrup for allowing a wearer's foot to be secured to the stirrup;

e. a plurality of tip attached to said lower surface of said sole portion;

f. at least two spikes attached to the stirrup such that centerline through at least one of the at least two spikes will not be parallel to a centerline through any one of said plurality of tips and rotating the stirrup will move the at least two spikes relative to the elongated shank and said at least two spikes arranged at spaced locations along a direction defined by the wearer's foot and extending outwardly and downwardly at an inclined angle relative to the shank so that the spikes are able to penetrate into a tree being climbed by the wearer of the climbing apparatus; and g. a transversely mounted spring and a pin intermediate said shank and said leg support to provide tilting of said leg support and absorption of forces.

27. The climbing apparatus of claim 26 wherein said stirrup is comprised is a sole portion and an anterior portion rotatably connected to said sole portion.

28. The climbing apparatus of claim 26 further comprising said leg support having anchor points on opposite sides thereof and a strap attached to said anchor points to allow said leg support to be secured to the wearer's leg.

* * * * *

UNITED STATES PATENT AND TRADEMARK OFFICE

CERTIFICATE OF CORRECTION

PATENT NO. : 5,853,067

DATED : December 29, 1998

INVENTOR(S) : HURSE ADRIAN CUTLER

It is certified that error appears in the above-indentified patent and that said Letters Patent is hereby corrected as shown below:

Column 8, claim 13, line 25, after the second occurrence of "at", insert --an--.

Column 10, claim 26, line 4, after "rotatably" insert --attached--.

Column 10, claim 26, line 10, change "tip" to --tips--.

Signed and Sealed this

Fourteenth Day of September, 1999

*Attest:*

Q. TODD DICKINSON

*Attesting Officer*

*Acting Commissioner of Patents and Trademarks*